US005280854A

United States Patent [19]

Das

[11] Patent Number: 5,280,854

[45] Date of Patent: Jan. 25, 1994

[54] ROBOTIC SPRINKLER HEAD

[76] Inventor: Subhendu Das, 9732 Kessler Ave., Chatsworth, Calif. 91311

[21] Appl. No.: 907,743

[22] Filed: Jun. 29, 1992

[51] Int. Cl.[5] ..... B05B 3/02

[52] U.S. Cl. ..... 239/227

[58] Field of Search ..... 239/227, 67, 70, 74

[56] References Cited

U.S. PATENT DOCUMENTS

| | | | |
|---|---|---|---|
| 1,308,371 | 7/1919 | Roach | 239/67 |
| 3,575,351 | 4/1971 | Warren | 239/227 |
| 4,073,438 | 2/1978 | Meyer | 239/227 |
| 4,198,001 | 4/1980 | Rodriguez | 239/227 |
| 4,261,514 | 4/1981 | Kennard et al. | 239/227 |
| 4,474,328 | 10/1984 | Hale | 239/227 |
| 4,664,720 | 5/1987 | Rucker | 239/227 |
| 4,671,462 | 6/1987 | Badria | 239/227 |
| 4,708,290 | 11/1987 | Osmond | 239/227 |
| 4,889,004 | 12/1989 | Mailliet et al. | 239/227 |
| 4,913,351 | 4/1990 | Costa | 239/74 |
| 4,986,476 | 1/1991 | Hour | 239/227 |
| 5,009,368 | 4/1991 | Streck et al. | 239/70 |

*Primary Examiner*—Andres Kashnikow
*Assistant Examiner*—Lesley D. Morris

[57] ABSTRACT

A computer controlled sprinkler head with an outlet pipe (14) that can turn in both horizontal and vertical planes. By positioning the outlet pipe at suitable angle any location can be precisely irrigated. This precise irrigation will save significant amount of water compared to conventional systems. In many situations only one sprinkler head will be enough to irrigate an entire lawn, eliminating under ground network of pipe lines. The sprinkler head is programmable and portable.

8 Claims, 7 Drawing Sheets

ROBOTIC SPRINKLER HEAD

BACKGROUND—FIELD OF INVENTION

This invention relates to watering lawns and gardens.

BACKGROUND—DESCRIPTION OF PRIOR ART

The most popular sprinkler system used today involves laying out a network of underground pipelines and connecting several sprinkler heads to this network. These sprinkler heads are laid out uniformly over the area to be irrigated. Laying of underground network is labor intensive and therefore very expensive. The sprinkler heads attached to this network waters a circular region. To cover the lawn effectively, these circular regions are designed to overlap each other. This overlapping causes a significant amount of waste of water in the overlapped region. On a narrow strip of lawn between the sidewalk and the street the overlapping causes watering the street, a complete wastage.

The major disadvantages of this system are:

1. It is very expensive because it requires labor intensive network of trenches over the lawn.
2. It wastes water. The system requires that the areas covered by the sprinkler heads must overlap. The overlapping areas get 2 to 4 times more of the required water, depending on how many heads overlap an area.
3. This system performs inefficiently when water pressure varies. If pressure is high, it wastes more water by increasing the overlapped area. When pressure is low, it does not water properly all the areas. The system cannot adjust itself to the variation of water pressure.
4. Once designed and in operation, it cannot be changed without incurring on costs.
5. This system requires a complicated initial design on paper of installation scheme.

OBJECTS AND ADVANTAGES

The concept behind the prior art as described above, i.e. watering the lawn by a set of uniformly distributed sprinkler heads, could be elegant. Its wide spread use in real estate properties demonstrate the usefulness of the concept. But the technology has changed significantly in the last decade. Computer and electronics have become widely available, they can be inexpensive and small. This technology can now be used to introduce a new concept on watering lawns and gardens. This concept uses a single computer controlled sprinkler head located at a selected fixed place in the lawn. This approach replaces the distributed concept by a localized concept.

The sprinkler head, presented in this invention, has a nozzle connected to its outlet pipe. Unlike conventional sprinklers, the nozzle produces a jet of water. This water jet travels like a projectile and lands at a distance from the sprinkler head to water a small circular area at that location.

The outlet pipe, to which the nozzle is connected, can rotate in both horizontal and vertical planes. The rotation of the nozzle in the vertical plane controls the distance where water drops. Maximum distance covered depends on different factors. Most important factor is the water pressure. A medium size lawn (100'×100') can be covered from a single location under normal water pressure. The shape, size and design of the nozzle are also important factors. The rotation of the nozzle in the horizontal plane moves the water jet to a different position along a circular path. Thus by controlling the horizontal and vertical angle of the outlet pipe, any location, within the range of water pressure, can be irrigated. Note that, instead of nozzle other type of fittings can be attached to the outlet pipe.

The rotation of this outlet pipe is controlled by a computer, and therefore can be programmed to remain stationary and water any fixed location for any length of time. It can also be programmed to sweep uniformly any arbitrarily shaped lawn. The software can be written to provide many interesting features not available in the traditional systems. It can also be written to provide a very simple user interface, like a joy stick to program the device. This report, however, provides a hand held keyboard and display unit as user interface.

To make the system more effective, a pressure sensor and a control valve have been added. By controlling the valve position the pressure and the flow rate are adjusted. The vertical angle of the outlet pipe is also adjusted depending on the variation of water pressure. These features help to save a significant amount of water during the irrigation of gardens and lawns.

The following are the advantages of the robotic sprinkler head:

1. It requires only one underground pipe line, from the water source to the location of the sprinkler head. Therefore its installation cost is cheaper. The total cost of implementing this computer controlled system may be less than half of the traditional system.
2. It saves water by eliminating overlapping and providing precise irrigation. It does not require to water an area more than it is programmed to cover. It can very uniformly cover an entire area.
3. The system is pressure sensitive. It continuously monitors water pressure. When the sprinkler is programmed it saves in computer memory the water pressure for all the angular positions of the outlet pipe. During normal operation, when the current water pressure is higher than the programmed pressure the system reduces the water pressure by turning the valve. When the programmed pressure is higher than the current water pressure the head adjusts the vertical angle of the outlet pipe to control the distance. Thus the system irrigates the same location even when the water pressure changes. This helps to save water by not irrigating unwanted areas.
4. Since the system is software controlled, it can be reprogrammed using the user interface to meet the changing needs of the garden. For example, if a plant is moved from one location to another, the sprinkler can be programmed to stop watering the previous location, and start watering the new location.
5. The system does not require any theoretical design on paper. Before permanent underground installation, the system can be tested thoroughly by placing it over the ground and connecting it to a water hose. Once the location and programming is verified the system can be permanently installed.

The invention has the additional advantages:

6. The device is portable. When the owner moves to a new house he or she can take the sprinkler head to the new location, reinstall the system, and reprogram it to conform with the new lawn.
7. It can uniformly water lawns of arbitrary shape within the range of the sprinkler head.

Further objects and advantages of the invention will become apparent from a consideration of the drawings and ensuing description.

DRAWING FIGURES

Figure 4:
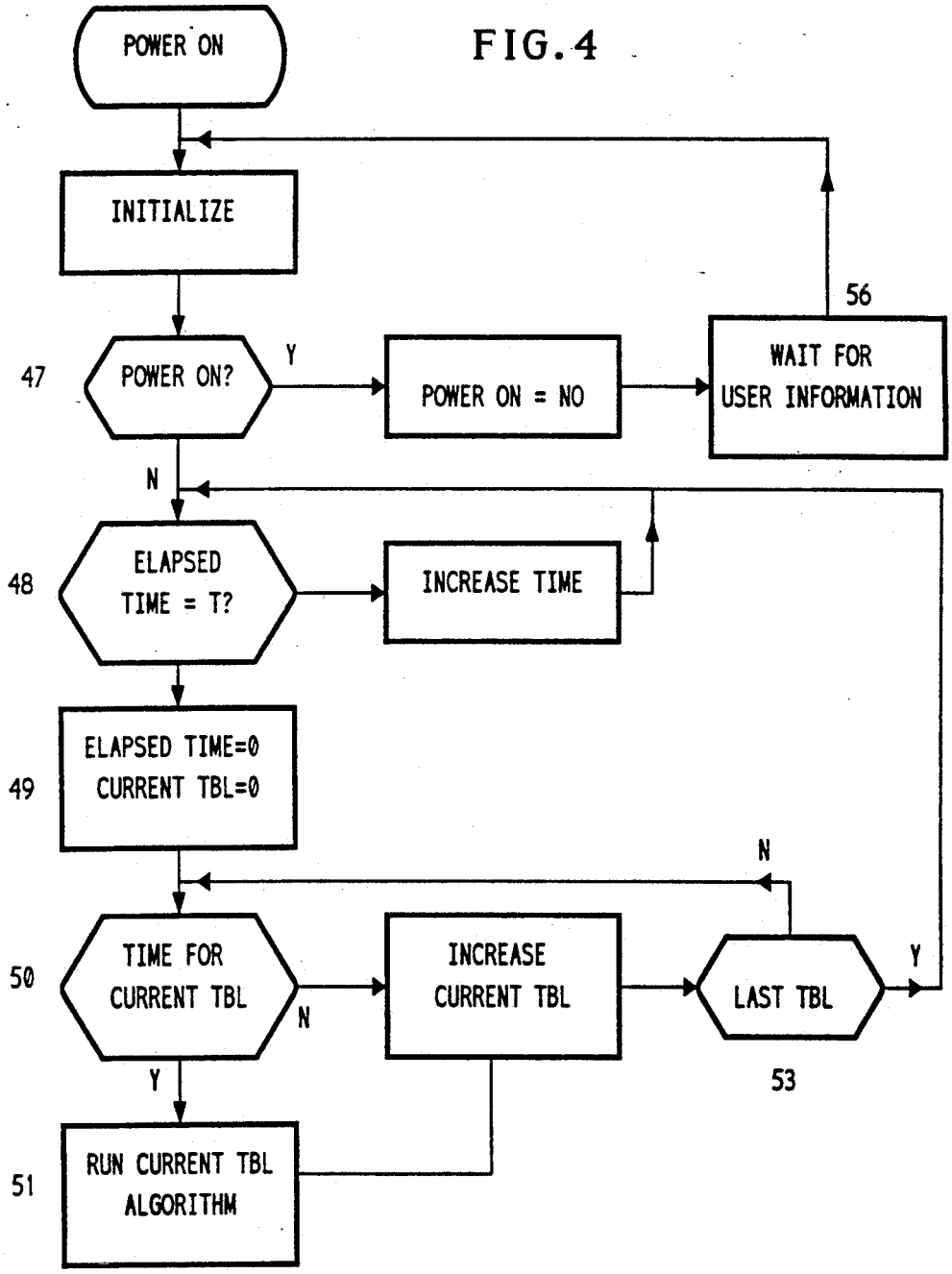

FIG. 4 Overview of the main program.

Figure 5:
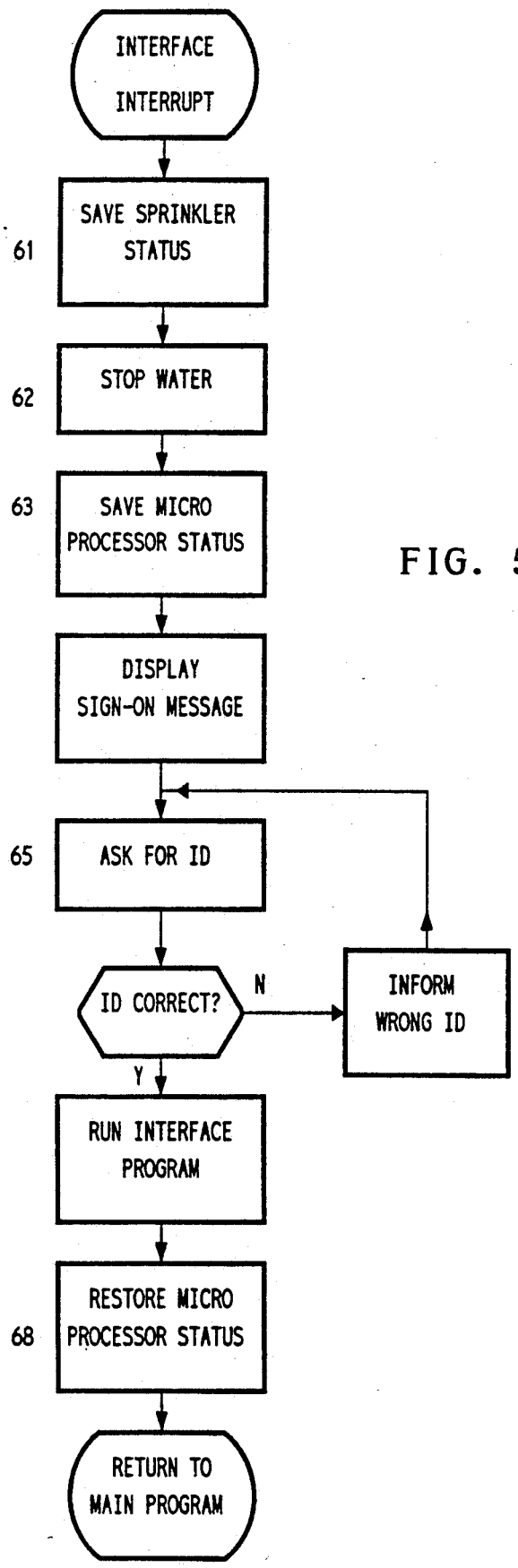

FIG. 5 Overview of the user interface device interrupt routine.

Figure 6:
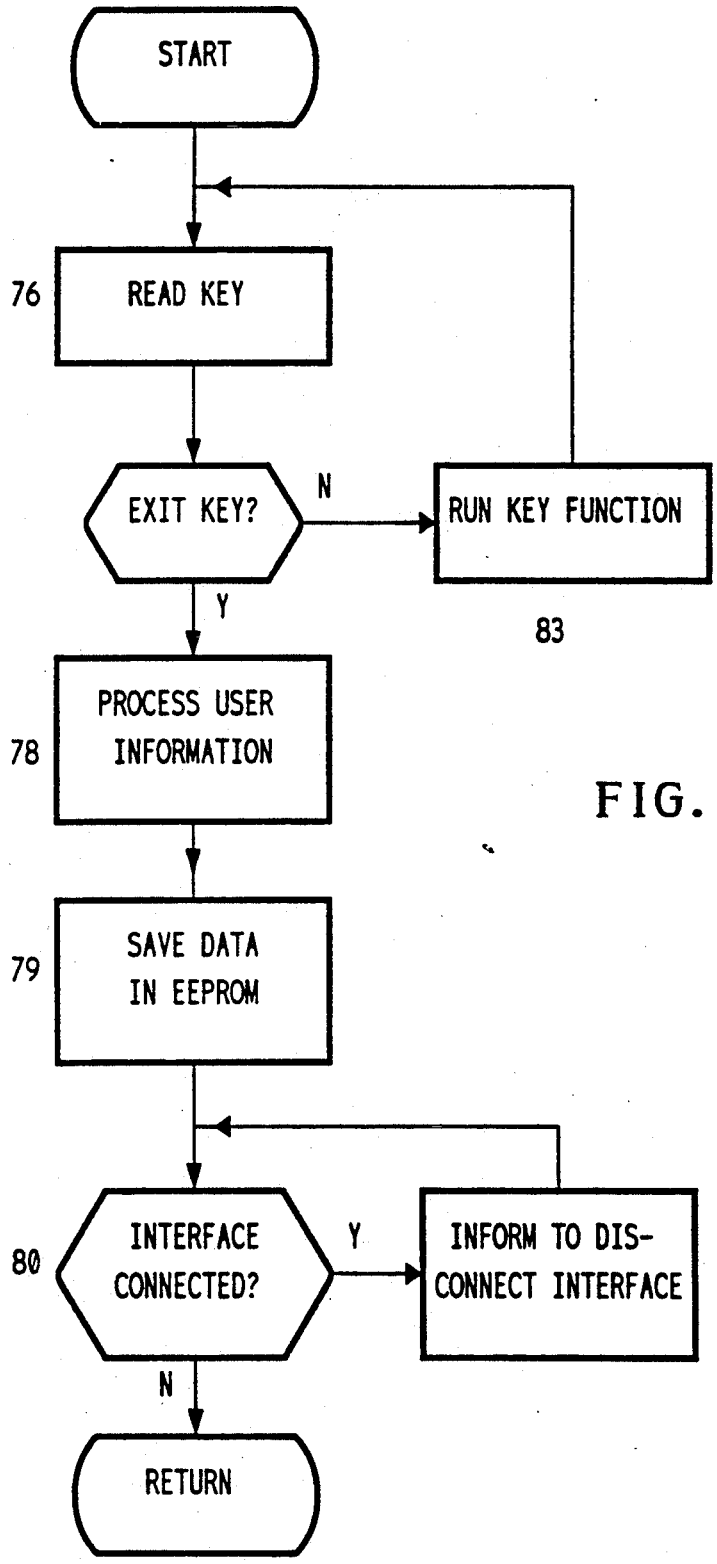

FIG. 6 Overview of the user interface program.

Figure 7:
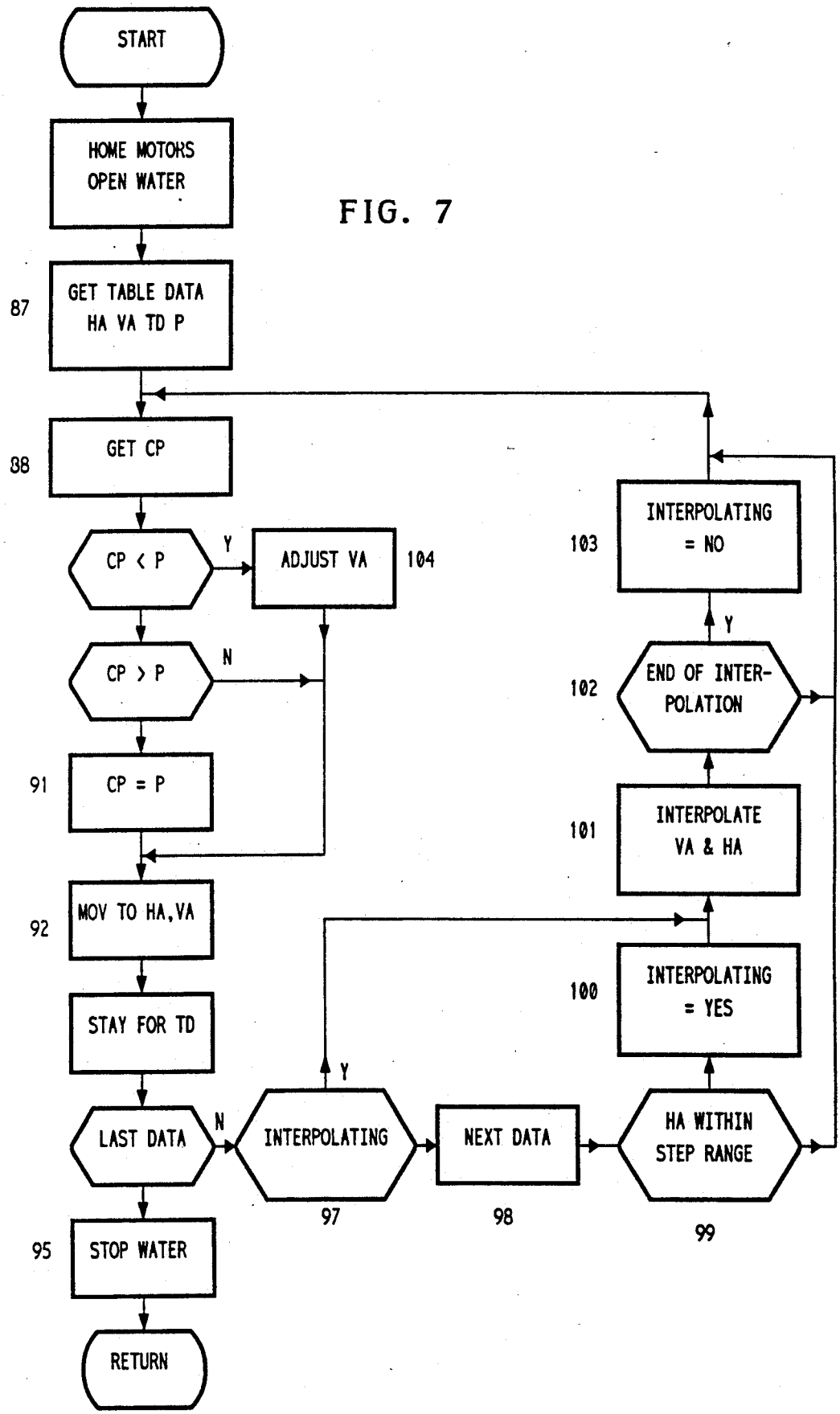

FIG. 7 Overview of the operational algorithm.

DESCRIPTION—FIGS. 1 TO 3

Figure 1:
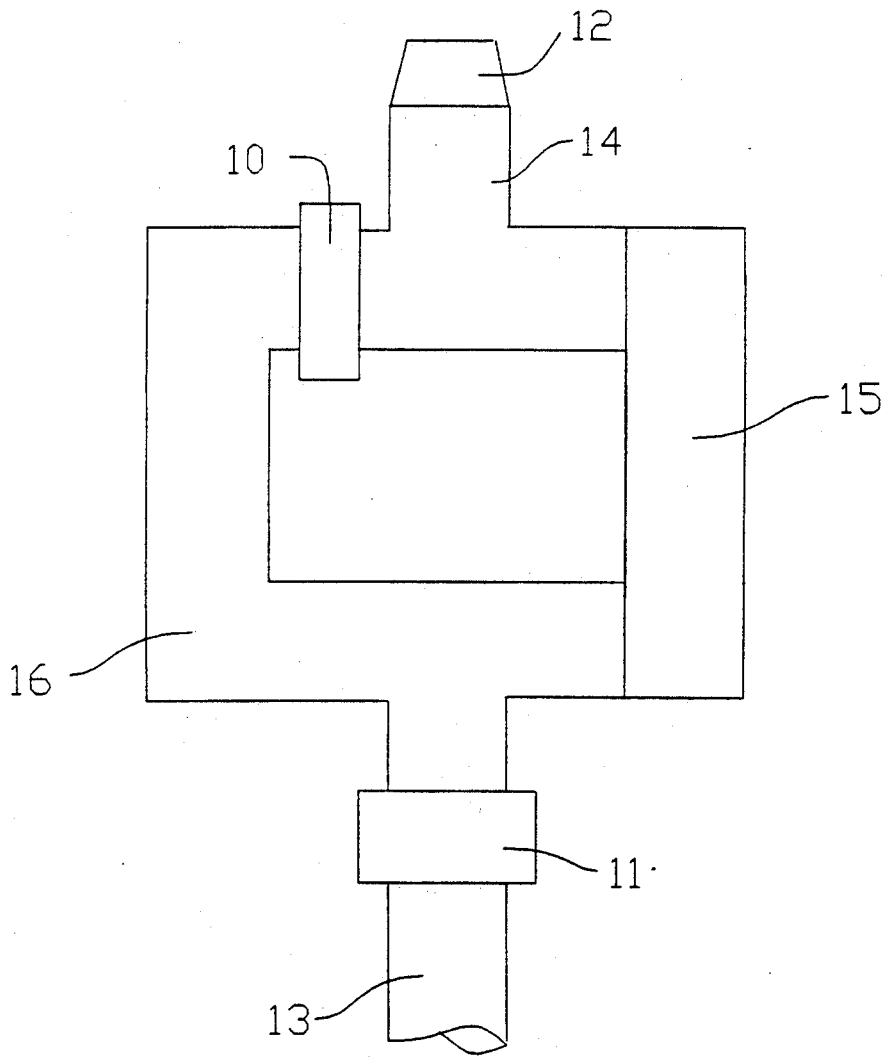
FIG. 1 Shows the pipe mechanism for the sprinkler head.

FIG. 1: This figure describes an embodiment of the concept used in the sprinkler head. The concept is to provide rotational capability of the sprinkler outlet pipe 14 in both vertical and horizontal planes. This is implemented by the use of two swivel joints 10 and 11. Swivel joint 11 will allow body 16 to rotate with respect to pipe 13 along the vertical axis of swivel joint 11. Swivel joint 10 will allow outlet pipe 14 to rotate with respect to body 16 along the horizontal axis of swivel joint 10. These two swivel joints allow complete 360 degrees rotation of the outlet pipe 14 around their respective axes. Swivel joint 10 permits the rotation of outlet pipe 14 in the vertical plane perpendicular to its axis. Similarly, swivel joint 11 permits the rotation of outlet pipe 14 in the horizontal plane perpendicular to its axis.

Water enters through inlet pipe 13, swivel joint 11, and turns left and goes through body 16, swivel joint 10 to outlet pipe 14, and finally exits through nozzle 12. Water does not flow through supporter 15. Supporter 15 is not a tube, its purpose is to hold 16 and 14 together. The design of the pipe fittings is such that water pressure does not turn the outlet pipe 14 in any direction. Thus the outlet pipe 14 remains stationary at any predetermined horizontal and vertical angular position even when water flows through it. It is an important feature of this invention. This permits to use smaller size motors (described in FIG. 2) to control the motion of the outlet pipe 14. Also the motors can be turned off while irrigating in a stationary position, saving electrical energy.

Water comes out of nozzle 12, travels as a projectile, and lands at a distance. The sprinkler head irrigates only the small area where water lands. It does not sprinkle like a curtain of water, i.e. it does not water anywhere between the location of the sprinkler and the landing area. This is an important concept used in the design and operation of this new sprinkler head. This feature will allow to irrigate disjoint lawns, e.g., it will be able to water the small strip of lawn on the other side of the sidewalk without watering the sidewalk. This landing distance is controlled by changing the verticle angle of outlet pipe 14 in the vertical plane. When outlet pipe 14 is at some fixed vertical angle in the vertical plane, by rotating body 16 the lawn can be irrigated along a circular ring. The radius of this circular ring is controlled by changing the vertical angle of outlet pipe 14 in the vertical plane and the location on the ring is controlled by changing the horizontal angle of outlet pipe 14 in the horizontal plane.

This figure is used only to demonstrate the concept of two dimensional rotation. Many different designs are possible. For example, the supporter 15 can be replaced by a water carrying tube with an additional swivel joint. A completely different structural design of the pipe mechanism is also possible.

Figure 2:
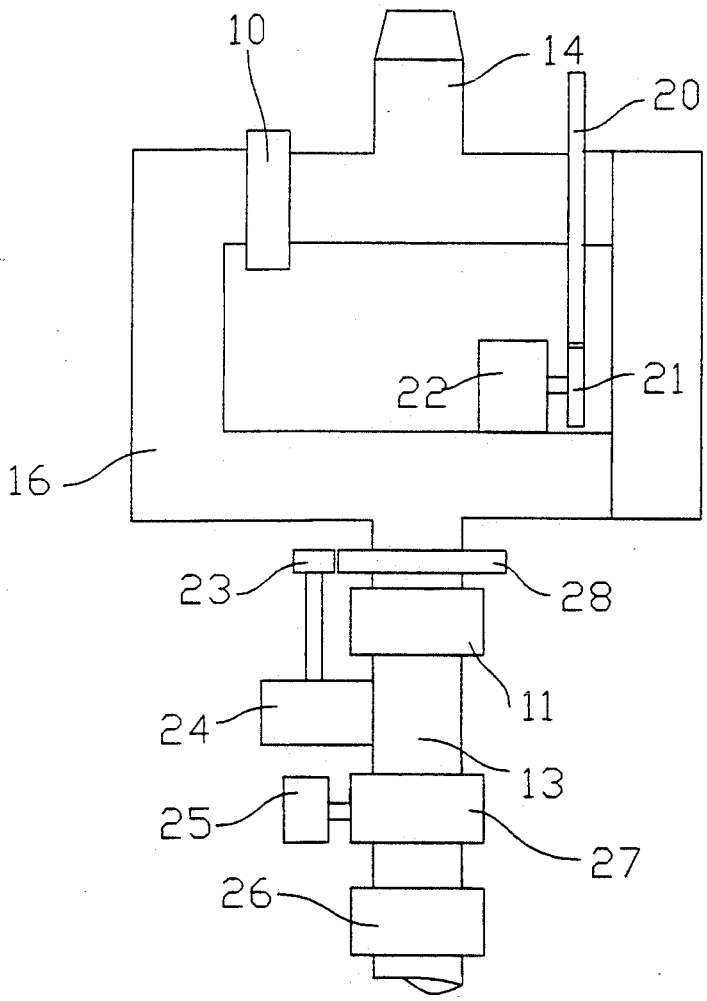
FIG. 2 Shows the complete robotic sprinkler head.

FIG. 2: This figure is same as FIG. 1 except it shows the motors and gears required to rotate the outlet pipe 14. The drives shown in this embodiment are electric stepper motors, but in general it can be any other type of drives, for example, solenoids. Similarly, gears are used to show power transmission method, but alternate means like belts and chains may also be used. 22 and 24 are stepper motors. 23 and 28 represent two gears. Gear 28 is attached to body 16 and gear 23 is attached to the shaft of motor 24. Motor 24 is fixed with inlet pipe 13. Thus when motor 24 turns, body 16 turns with respect to inlet pipe 13. Thus motor 24 provides rotation of outlet pipe 14 in the horizontal plane. Similar mechanism is used to turn outlet pipe 14 in the vertical plane. Vertical plane motion is provided by motor 22. Motor 22 is fixed with body 16. Gear 20 is fixed with outlet pipe 14, and gear 21 with the shaft of motor 22. When motor 22 rotates, outlet pipe 14 rotates with respect to body 16 around swivel 10. 27 is a control valve and 26 is a water pressure sensor. 27 is controlled by stepper motor 25. Again stepper motor 25 can be replaced by any other suitable drive. Stepper motors 22, 24, and 25 can be controlled by a computer and programmed to provide, while in operation, capability of completely independent directional and angular motion of the outlet pipe 14 in both horizontal and vertical planes, multiple start and stop times of water flow, and smooth control of pressure of water flow through the outlet pipe 14. This means that, the outlet pipe 14 can be rotated in clockwise or counterclockwise in the vertical plane independent of its direction of rotation in the horizontal plane. The same applies to the amount of the angular movement. Water can be stopped, the outlet pipe 14 can be moved to a different angular location, and water can be started again. Thus saving water by not irrigating unwanted area. It will reduce water pressure when irrigating areas near the sprinkler head, avoiding creation of dent on the lawn surface. The computer will also read output of the pressure sensor 26, continuously or several times whenever required, and can be programmed to provide pressure sensitive operation of the sprinkler head. The details of the computer control is discussed later.

Figure 3:
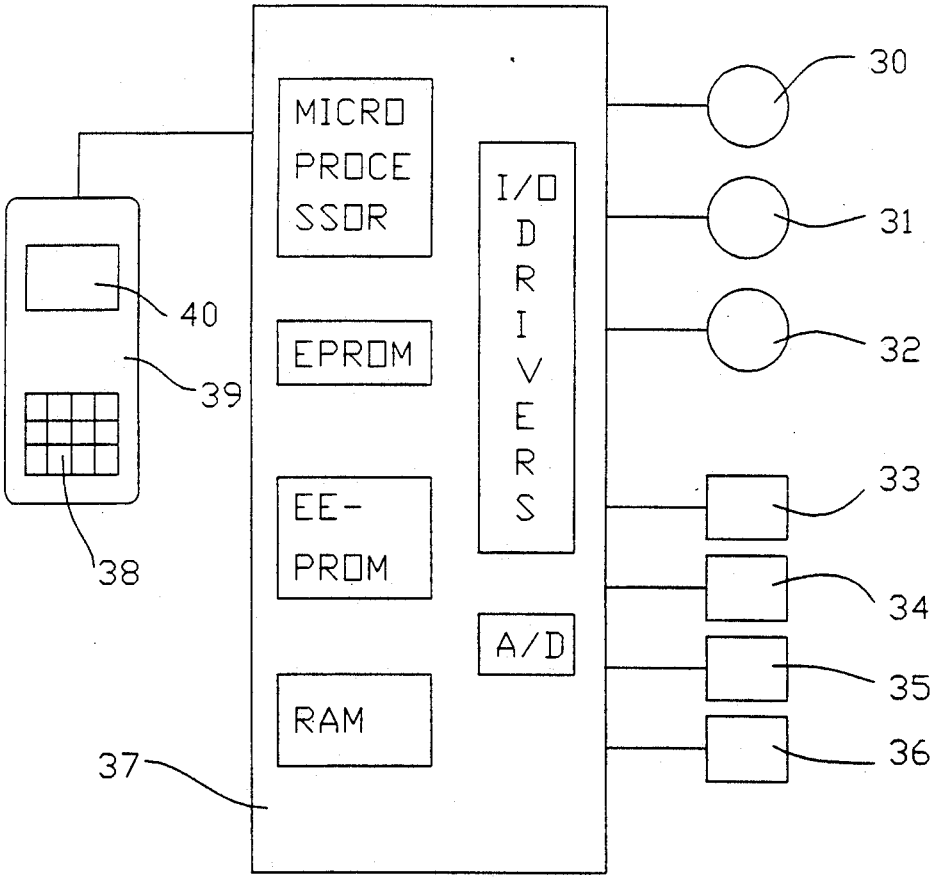
FIG. 3 Shows the system level diagram of the sprinkler controller.

FIG. 3: This figure describes the sprinkler controller. 37 is the printed circuit board. It contains a microprocessor, memory devices (EPROM, EEPROM, RAM), Input/Output drivers, and an Analog to Digital (A/D) converter. 30,31, and 32 are stepper motors. Two of them are used to rotate the outlet pipe of the sprinkler head. The third motor is used to control the water flow. The A/D device is connected to a pressure sensor 33 to monitor the water pressure. 34,35, and 36 are sensors to find initial starting positions of the three stepper motors. When motors come to their initial home positions, these sensors provide electrical signals. 39 is an user interface device. The interface can be attached to the computer board 37 to program the sprinkler head. Once programmed the interface can be disconnected. 38 is a small key board for entering information. 40 is a Liquid Crystal Display (LCD) unit for helping the user to program the device. The microprocessor displays messages on this LCD unit. The following keys are provided as part of key board 38: Water, Move, Enter, Edit, Time, Run, Exit, Home, Up, Down, Right, and Left. Their functions are described later.

The electronics described here is the preferred method of controlling the sprinkler head. Many design alternatives are available. For example, a powerful computer can be used to remotely control multiple sprinkler heads.

OPERATION FIGS. 4–7

FIG. 4: This flow chart describes the operation of the main software. It executes at power on or after a reset. Decision box 47 checks if the system is powered on from power off state. If it is, then it will wait for user information. This power on information comes from the execution of box 56 routine, which is described in more detail in FIG. 6. In box 48 the system waits for T seconds in an idle loop. The value of T is an user defined constant. The default is 1 second. Once T seconds are over the program checks if any lawn needs to be watered. If it is not time for any of the lawns to be watered then the system goes back to the idle mode and counts time. Each lawn or plant is represented as a table in the program. If it is time to water a lawn or a plant, the program picks-up the corresponding table and processes it by executing box 51. The details of Box 51 is given in FIG. 7.

In box 49, the elapsed time and current table number are initialized to zero. In the decision box 50, the program checks for the time of current table. If the time of the current table matches with the current time, then the program executes the current table in box 51. If the times do not match it checks for the next table. Box 52 increases the current the table number. If the current table is not the last table, which is checked in box 53, it executes decision box 50, otherwise it goes to decision box 48.

FIG. 5: It is the user interface device interrupt routine. This routine gets activated when the interface unit is connected to the computer. In box 61 the processor saves the current status of the sprinkler. Box 62 turns off water. In box 63 the microprocessor status is saved. All this status information will be required to restart the system from its current operating condition. In box 65 the system asks for the user ID or password. The system will not work until the correct ID is entered. After receiving the correct ID the system runs the user interface routine defined by box 67, which is described in details in FIG. 6. In box 68 the system restores the previous status and then returns to continue operation of the interrupted main program.

FIG. 6: This is the user interface program. This program looks for depression of a key in the key board. This is done in box 76. If the depressed key is the exit key then processor goes to box 78. For all other keys, key functions are processed by box 83. Once all the information required for programming the sprinkler is supplied by the user, the user presses the exit key. The function of the exit key is to check the integrity of the data provided and save them in the non-volatile memory. This is done by the boxes 78 and 79. In the decision box 80 the system waits for the disconnection of the key board. Once the key board is disconnected the system goes into the normal operation mode defined by the main program of FIG. 4.

The following key functions may be provided by the box 83 of FIG. 6:

| | | |
|---|---|---|
| Water: | This key, when pressed will toggle the water flow valve, i.e if the flow is on, pressing this key will stop the flow or vice versa. When this key is active, the arrow keys will have the following functions: | |
| | Up and Right: | Increase the water flow. |
| | Down and Left: | Decrease the water flow. |
| Move: | This key will move the sprinkler nozzle. When active, the arrow keys will have the following functions: | |
| | Up: | Turn the nozzle upward in vertical plane. |
| | Down: | Turn the nozzle downword in vertical plane. |
| | Right: | Turn the nozzle clockwise in horizontal plane. |
| | Left: | Turn the nozzle counterclockwise in horizontal plane. |
| Enter: | This key will store the user supplied data. For example, when user is moving the sprinkler head in vertical plane using Up arrow, the pressing of Enter key will store the position of the sprinkler head. | |
| Edit: | Will put the computer in edit mode. It will allow you to change the data. | |
| | Up, Right: | Will move in the forward direction. |
| | Down, Left: | Will show the data in reverse order. |
| | Delete: | Will remove the displayed entry from the table. |
| | Undelete: | Will restore the deleted data at the current cursor position. |
| | Insert: | Will insert a data between two data elements. |
| Time: | Will allow to set date and time of the processor clock. | |
| Run: | It will test run the currently displayed table. It will let you control the speed of test, i.e at normal or faster than normal speed it will perform the test. The test can be performed with water on or off. | |
| Exit: | Will complete the programming of the sprinkler. It will test the consistency of the data and will allow you to correct them, in case of errors. Pressing the Enter key will bring you out of the exit mode. | |
| Home: | This brings the horizontal and vertical motors to the initial starting positions. | |

FIG. 7: This figure describes the main operational algorithm. As mentioned before, each lawn and each plant is represented by a table. This table contains among other things, vertical (VA) and horizontal angles (HA) of the sprinkler outlet pipe, water pressure (P) and time duration (TD) for each angular position. In box 87 the processor reads this information from EEPROM. In box 88 the processor reads, via A/D device, the current water pressure (CP). It compares CP with the pressure (P) data from the table and accordingly performs the operations defined by the boxes 91 or 104. The processor then moves the motors to HA and VA positions as mentioned by box 92 and stays there for TD seconds. Thus computer gives the ability to irrigate precisely the same programmed area in the lawn even when water pressure fluctuates.

The program then reads the next data from the table. If the change in HA from previous position to current position is larger than the step size for horizontal movement the program enters an interpolation mode described by the boxes 97–103. The interpolation algorithm generates HA and VA between the last and current table entries. The interpolation algorithm may involve from simple table look-up to complicated numerical data processing. This is not described here to avoid complexity. Once interpolation is done the program reads the next data from the table and continues the operation as described above until it reaches the last data. It then stops water, as mentioned in box 95, and returns to the main program.

SUMMARY, RAMIFICATIONS, AND SCOPE

This invention describes a sprinkler head. The sprinkler head has a nozzle, attached to its outlet pipe, which ejects water as a jet. The location where the jet lands is controlled by turning the outlet pipe in vertical and horizontal planes. The head is pressure sensitive, i.e. it adjusts the vertical angle of the outlet pipe to the variation of water pressure. The water flow rate is controlled by controlling a valve in the inlet pipe. The sprinkler head is controlled by a microprocessor.

This sprinkler has the ability to sweep very precisely a lawn of any shape. It will not water any area outside the lawn even when the water pressure varies. Therefore it will save water in comparison with the traditional sprinkler systems. The specification describes various aspects of the product. These are mentioned only to justify the feasibility of the concept. What is invented is not the product specification but the concept behind the product. The scope of the invention should be determined by the appended claims and their legal equivalents rather than by the product specification.

I claim:

1. A sprinkler head comprising;

an inlet pipe adapted to be connected with a source of water under pressure, a body rotatably connected to said inlet pipe for rotation about a substantially vertical axis and having a flow passage fluidly connected with said inlet pipe, an outlet pipe having a central axis, said outlet pipe being rotatably connected to said body for rotation about a substantially horizontal axis, said central axis being rotated in a vertical plane perpendicular to said horizontal axis, said outlet pipe having a flow passage fluidly connected with said flow passage of said body, means for rotating said body and said outlet pipe relative to said inlet pipe and to one another, thereby allowing said central axis of said outlet pipe to be positioned to arbitrary angles with respect to said vertical plane and a horizontal plane perpendicular to said vertical axis.

2. A sprinkler head of claim 1 wherein said outlet pipe is further oriented so that said central axis of said outlet pipe is substantially perpendicular to said horizontal axis and remains in a vertical plane containing said vertical axis, thereby preventing a rotating torque in said outlet pipe by the force of the water.

3. A sprinkler head of claim 1 further comprising a nozzle means coaxially connected to and having a flow passage with said outlet pipe for delivering water along a path of a projectile, to irrigate a small area at a distance from the sprinkler head.

4. A sprinkler head of claim 3 further comprising means to maintain said outlet pipe in a stationary condition at a predetermined position for a predetermined length of time, thereby allowing irrigation of a predetermined area for a predetermined length of time.

5. A sprinkler head of claim 4, further comprising a valve means connected for said inlet pipe to centrolling water flow through said inlet pipe.

6. A sprinkler head of claim 5, further comprising a drive means to control said valve, said drive means controlling independently, multiple stop times, multiple start times, and volume of water flow continuously in time and continuously in quantity within its range of zero to maximum volume corresponding to completely closed and completely open conditions, respectively, of said valve.

7. A sprinkler head of claim 6, further comprising a pressure sensor means to continuously measure water pressure flowing through said inlet pipe, both continuously in time and continuously in a range of pressure values of zero to maximum pressure corresponding to completely closed and completely open conditions, respectively, of said valve.

8. A sprinkler head of claim 7, further comprising a control means, for adjusting the position of said outlet pipe in said vertical plane, for adjusting said valve, in response to a variation of said water pressure measured by said pressure sensor, thereby maintaining irrigation of said small area at said distance under a variation of said water pressure.

* * * * *